US009026020B2

(12) United States Patent
Chikugo

(10) Patent No.: US 9,026,020 B2
(45) Date of Patent: May 5, 2015

(54) FIXING APPARATUS INCLUDING GUIDING MEMBER CONFIGURED TO GUIDE A SHEET TOWARD A NIP AT WHICH A TONER IMAGE ON THE SHEET IS FIXED

(71) Applicant: Canon Kabushiki Kaisha, Tokyo (JP)

(72) Inventor: Youichi Chikugo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 13/863,730

(22) Filed: Apr. 16, 2013

(65) Prior Publication Data

US 2013/0279953 A1 Oct. 24, 2013

(30) Foreign Application Priority Data

Apr. 23, 2012 (JP) ..... 2012-097655

(51) Int. Cl.
*G03G 15/20* (2006.01)
*G03G 15/00* (2006.01)

(52) U.S. Cl.
CPC ..... *G03G 15/2085* (2013.01); *G03G 15/657* (2013.01); *G03G 2215/00413* (2013.01); *G03G 15/2028* (2013.01)

(58) Field of Classification Search
CPC ..... G03G 15/2028; G03G 15/2085; G03G 15/657; G03G 2215/00413
USPC ..... 399/322, 400; 219/216
See application file for complete search history.

(56) References Cited

U.S. PATENT DOCUMENTS

| | | | | | |
|---|---|---|---|---|---|
| 5,285,245 | A * | 2/1994 | Goto et al. | 399/322 |
| 5,477,314 | A * | 12/1995 | Tsuchiya et al. | 399/107 |
| 6,741,832 | B2 | 5/2004 | Tomatsu | |
| 7,020,431 | B2 * | 3/2006 | Sahara | 399/400 |
| 7,680,449 | B2 * | 3/2010 | Shimizu | 399/400 |
| 7,890,024 | B2 | 2/2011 | Hirayama et al. | |
| 7,890,038 | B2 | 2/2011 | Chikugo et al. | |
| 8,798,488 | B2 * | 8/2014 | Ishikuro | 399/44 |
| 8,821,055 | B2 * | 9/2014 | Ukai | 400/693 |
| 2002/0131801 | A1 | 9/2002 | Tomatsu | |
| 2012/0034004 | A1 * | 2/2012 | Ishii | 399/322 |

FOREIGN PATENT DOCUMENTS

| | | | |
|---|---|---|---|
| JP | 2002-278329 | A | 9/2002 |
| JP | 2006221087 | A * | 8/2006 |
| JP | 2008003369 | A * | 1/2008 |
| JP | 2010-250094 | A | 11/2010 |

* cited by examiner

*Primary Examiner* — Robert Beatty
(74) *Attorney, Agent, or Firm* — Fitzpatrick, Cella, Harper & Scinto

(57) ABSTRACT

A fixing apparatus includes: a fixing device for fixing a toner image on a sheet at a nip; and a guiding member for guiding the sheet toward the nip. The guiding member includes: an electroconductive metal plate which is electrically grounded; and an insulating resin member, provided to cover a part of the metal plate, slidable with the sheet. The resin member includes: a plurality of openings, provided at different positions with respect to a direction perpendicular to a sheet conveyance direction, for permitting exposure of the metal plate along the sheet conveyance direction; and a downstream portion, substantially free from a stepped portion, which is provided at a downstreammost portion with respect to the sheet conveyance direction and which is extended flat in the direction perpendicular to the sheet conveyance direction in a sheet conveyance region.

14 Claims, 8 Drawing Sheets

FIXING APPARATUS INCLUDING GUIDING MEMBER CONFIGURED TO GUIDE A SHEET TOWARD A NIP AT WHICH A TONER IMAGE ON THE SHEET IS FIXED

FIELD OF THE INVENTION AND RELATED ART

The present invention relates to a fixing apparatus for fixing a toner image on a sheet. The fixing apparatus is usable in an image forming apparatus such as a copying machine, a printer, a facsimile machine or a multi-function machine having a plurality of functions of these machines.

In the fixing apparatus for fixing the toner image formed on the sheet at a nip, it has been known that a fixing member constituting a fixing device is electrically charged by sliding with the sheet. When such triboelectric charging of the fixing member is not negligible, there is a possibility that the sheet is electrostatically attracted to the fixing member to disturb an entering attitude of the sheet into the nip. When such a phenomenon is conspicuous, abnormal sheet conveyance such as buckling of the sheet or oblique movement of the sheet is caused to occur.

Therefore, an apparatuses described in Japanese Laid-Open Patent Application (JP-A) 2002-278329 and JP-A 2010-250094, the sheet is electrostatically attracted to a guiding member for guiding the sheet toward a nip of a fixing device.

Specifically, in the apparatus described in JP-A 2002-278329, a constitution in which the guiding member is formed with an electroconductive member and the sheet is electrostatically attracted to the guiding member is employed. In the case where such a guiding member is used, there is a possibility that a transfer current when the toner image is transferred onto the sheet flows into the guiding member to invite improper transfer. This phenomenon is conspicuous in the case of high temperature and high humidity environment and in the case where the content of water contained in the sheet is large.

Further, in the apparatus described in JP-A 2010-250094, the guiding member is constituted so that many rib portions formed of an insulating resin material are provided, along a sheet conveyance direction, on an electroconductive metal plate which is electrically grounded. These many rib portions are provided and arranged in a direction perpendicular to the sheet conveyance direction. Between adjacent rib portions, each of openings is formed, and the metal plate is exposed through these openings, so that the sheet is attracted to the metal plate.

However, in the guiding member described in JP-A 2010-250094, a constitution in which the sheet is attracted to the metal plate until the sheet reaches a downstreammost portion with respect to the sheet conveyance direction of the guiding member, and therefore there is a possibility that the following problem is caused.

Specifically, when the sheet is guided by the guiding member, a portion of the sheet opposing the openings (metal plate) is, compared with a portion of the sheet opposing the rib portions, in a state in which it sinks toward the metal plate. That is, when the sheet is guided by the guiding member, the sheet includes a portion where the sheet sinks toward the metal plate and a portion where the sheet does not sink in an alternating manner with respect to the direction perpendicular to the sheet conveyance direction, thus being placed in a waving state.

In the waving state of the sheet, when the sheet enters the nip, the sheet contacts the fixing member non-uniformly, thus causing improper fixing.

SUMMARY OF THE INVENTION

A principal object of the present invention is to provide a fixing apparatus capable of properly guiding a sheet toward a nip while attracting the sheet.

According to an aspect of the present invention, there is provided a fixing apparatus comprising: a fixing device for fixing a toner image on a sheet at a nip; and a guiding member for guiding the sheet toward the nip, wherein the guiding member comprises: an electroconductive metal plate which is electrically grounded; and an insulating resin member, provided to cover a part of the metal plate, slidable with the sheet, and wherein the resin member comprises: a plurality of openings, provided at different positions with respect to a direction perpendicular to a sheet conveyance direction, for permitting exposure of the metal plate along the sheet conveyance direction; and a downstream portion, substantially free from a stepped portion, which is provided at a downstreammost portion with respect to the sheet conveyance direction and which is extended flat in the direction perpendicular to the sheet conveyance direction in a sheet conveyance region.

These and other objects, features and advantages of the present invention will become more apparent upon a consideration of the following description of the preferred embodiments of the present invention taken in conjunction with the accompanying drawings.

Figure 8:
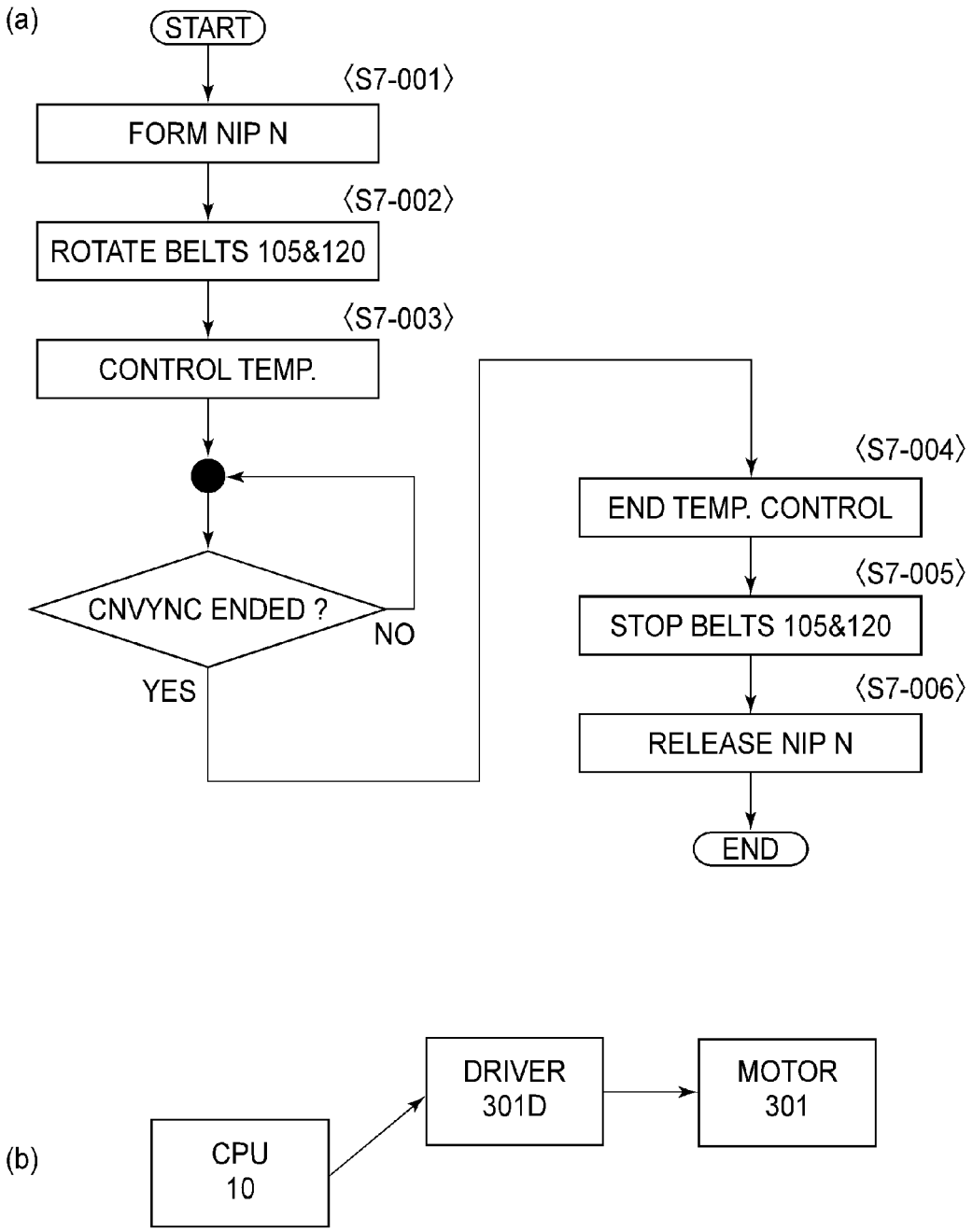

Part (a) of FIG. 8 is a flow chart of fixing operation control, and (b) of FIG. 8 is a block diagram of a control system.

Figure 9:
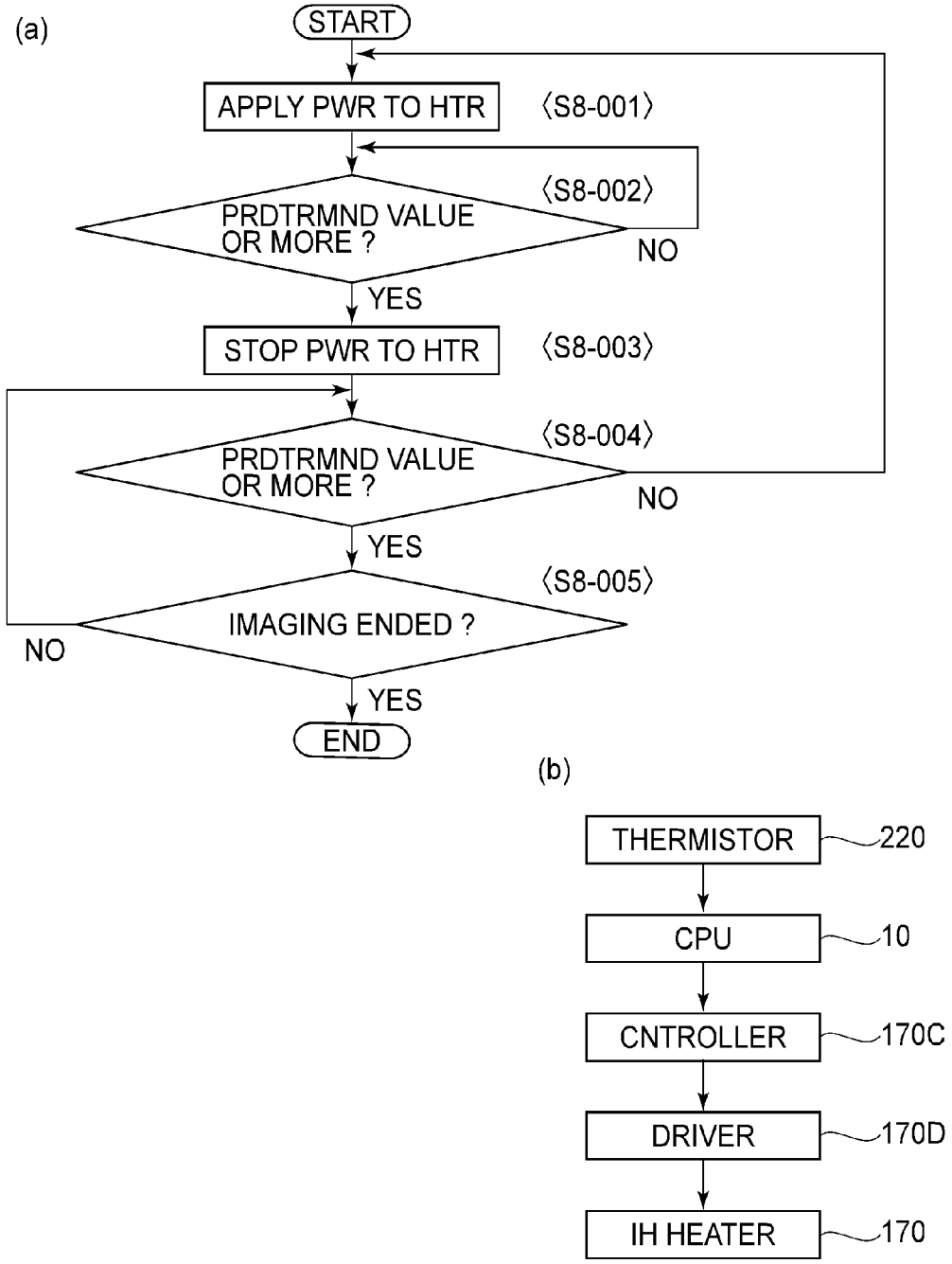

Part (a) of FIG. 9 is a flow chart of fixing belt temperature control, and (b) of FIG. 9 is a block diagram of a control system.

DESCRIPTION OF THE PREFERRED EMBODIMENTS

Embodiment (1) Image Forming Apparatus

Figure 5:
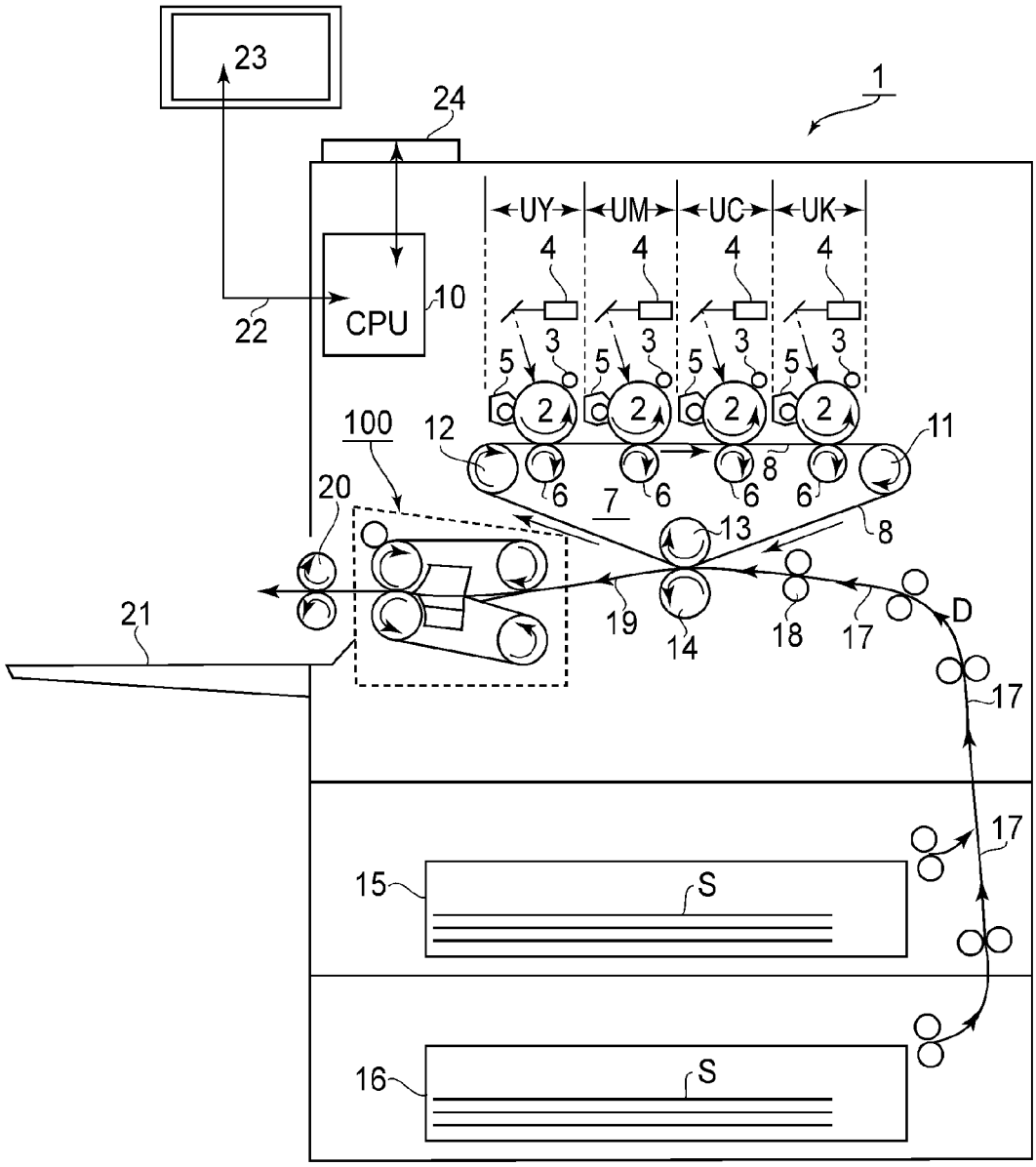
FIG. 5 is a schematic sectional view of an image forming apparatus in the Embodiment.

FIG. 5 is a schematic structural view of an image forming apparatus 1 in this embodiment and is taken along a conveyance direction (sheet conveyance direction) D of a sheet S. The image forming apparatus 1 is a four-color based full-color electrophotographic printer of an intermediary transfer in-line type. The printer 1 is capable of forming an image corresponding to image data (electrical image information) inputted from an external host device 23 connected with a printer controller (hereinafter referred to as CPU) 10 via an interface 22 and capable of outputting an image-formed product.

The CPU 10 is a control means for effecting integrated control of an operation of the printer 1, and transfers various electrical information signals between itself and the external host device 23 or a printer operating portion 24. Further, the CPU 10 effects processing of the electrical information signals inputted from various process devices and sensors and the like, processing of instruction (command) signals sent to the various process devices, predetermined initial sequence control and predetermined image forming sequence control. The external host device 23 may be, e.g., a personal computer, a network, an image reader, a facsimile machine, and the like.

Inside the printer 1, in FIG. 5, first to fourth (four) image forming portions U (UY, UM, UC and UK) are juxtaposed from a left side to a right side. The respective image forming portions U are the same electrophotographic image forming mechanism which are the same in constitution only except that the colors of toners as developers accommodated in developing devices 5 are yellow (Y), magenta (M), cyan (C) and black (K) which are different from each other.

That is, each of the image forming portions U includes an electrophotographic photosensitive drum 2 as a first image bearing member and includes, as process means acting on the drum 2, a charging roller 3, a laser scanner 4, the developing device 5, a primary transfer roller 6, and the like.

The drum 2 of each image forming portion U is rotationally driven in the counterclockwise direction indicated by an arrow at a predetermined speed. Then, on the drum 2 of the first image forming portion UY, a toner image of Y corresponding to a Y component image for a full-color image to be formed is formed. On the drum 2 of the second image forming portion UM, a toner image of M corresponding to an M component image is formed. Further, on the drum 2 of the third image forming portion UC, a toner image of C corresponding to a C component image is formed. On the drum 2 of the fourth image forming portion UK, a toner image of K corresponding to a K component image is formed. Toner image forming process and principle on the drums 2 of the respective image forming portions U are well known and therefore will be omitted from description.

At a lower portion of the respective image forming portions U, an intermediary transfer belt unit 7 is provided. This unit 7 includes a flexible endless intermediary transfer belt 8 as a second image bearing member. The belt 8 is extended and stretched among three rollers consisting of a driving roller 11, a tension roller 12 and a secondary transfer opposite roller 13. The belt 8 is circulated and moved in the clockwise direction indicated by an arrow at a speed corresponding to the rotational speed of the drums 2 by driving the driving roller 11. The secondary transfer opposite roller 13 is contacted to the belt 8 toward a secondary transfer roller 14 at predetermined pressure (urging force). A contact portion between the belt 8 and the secondary transfer roller 14 is a secondary transfer nip.

The primary transfer rollers 6 of the image forming portions U are provided inside the belt 8 and are contacted to the belt 8 toward lower surfaces of the drums 2. At each image forming portion U, a contact portion between the drum 2 and the belt 8 is a primary transfer nip. To the primary transfer roller 6, a predetermined primary transfer bias is applied at predetermined control timing.

The toner images of Y, M, C and K formed on the drums 2 of the image forming portions U are successively primary-transferred superposedly at the primary transfer portions onto the surface of the belt 8 which is circulated and moved. As a result, an unfixed full-color toner image including the superposed four color toner images is synthetically formed on the belt 8 and is conveyed to the secondary transfer nip.

On the other hand, sheets (recording material) S such as paper accommodated in a first cassette 15 or a second cassette 16 are separated one by one by an operation of a feeding mechanism (not shown), and then the separated sheet S is passed through a conveying path 17 to be sent to a registration roller pair 18. The registration roller pair 18 once receives and stops the sheet S, and corrects, in the case where the sheet S is obliquely moved, the sheet S to a normal (straight) movement state. Then, the registration roller pair 18 conveys the sheet S to the secondary transfer nip in synchronism with the toner image on the belt 8.

In a period in which the sheet S is nipped and conveyed at the secondary transfer nip, to the secondary transfer roller 14, a predetermined secondary transfer bias is applied. As a result, the full-color toner image is collectively secondary-transferred from the belt 8 onto the sheet S.

Then, the sheet S coming out of the secondary transfer nip is separated from the surface of the belt 8 and is passed through a conveying path 19 to be guided into an image fixing apparatus 100 as an image treating apparatus. The sheet S is heated and pressed in the fixing apparatus 100, so that the unfixed toner image is fixed as a fixed image. The sheet S coming out of the fixing apparatus 100 is conveyed and discharged, as a full-color image-formed product, onto a discharge tray 21 by a discharging roller pair 20.

(2) Fixing Apparatus 100

Figure 6:
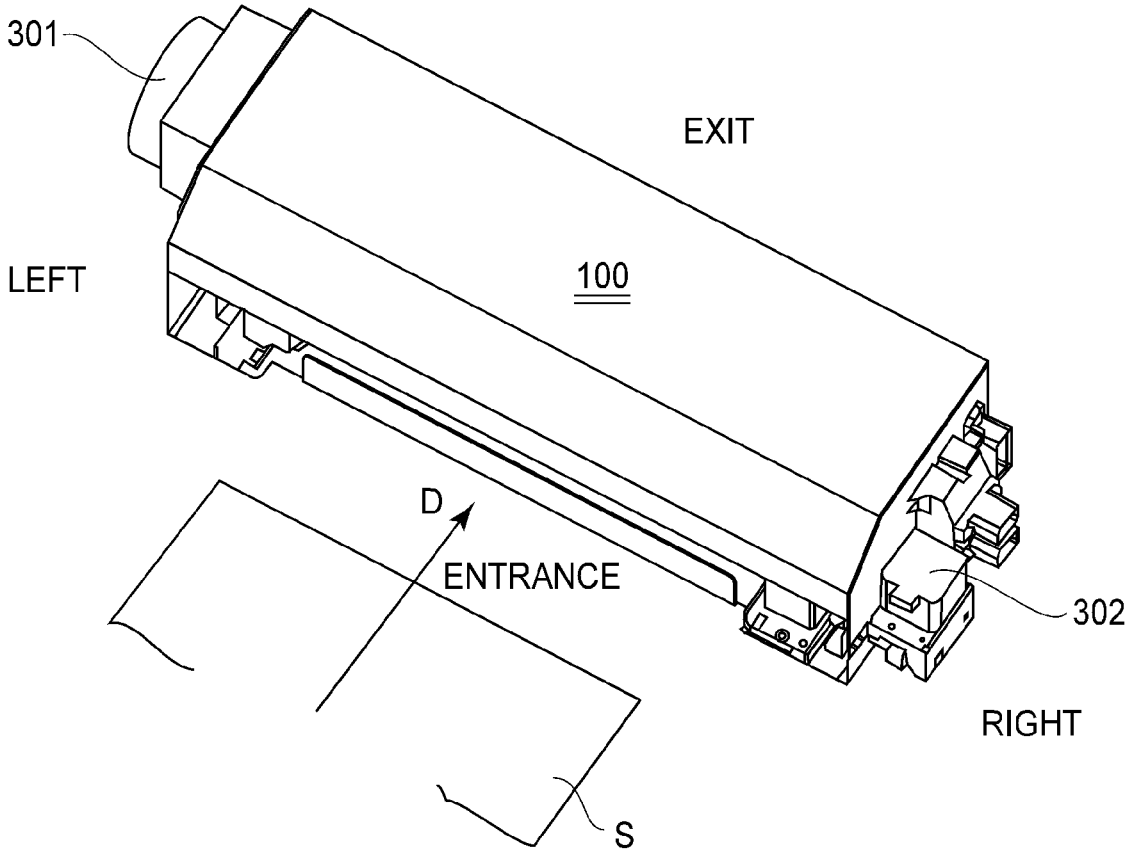
FIG. 6 is a perspective view of a fixing apparatus in the Embodiment.
Figure 7:
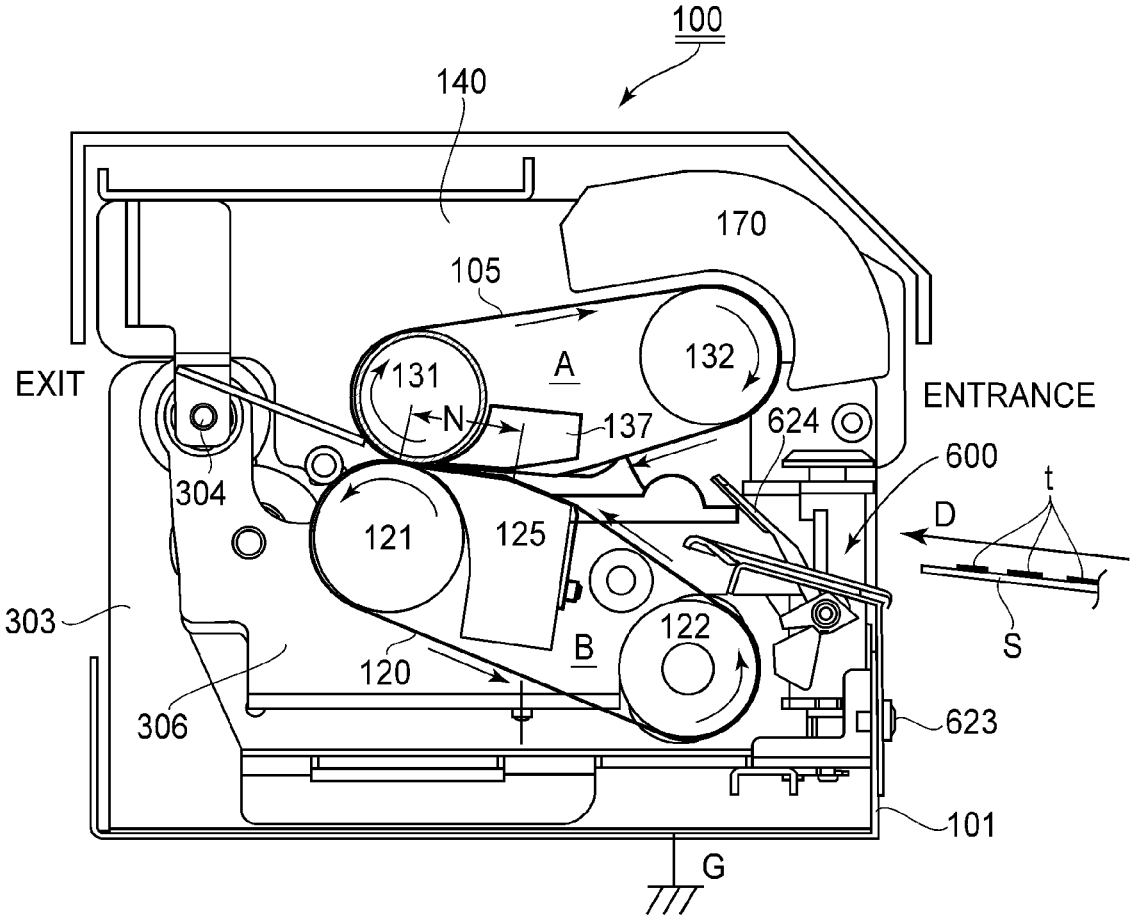
FIG. 7 is a schematic cross-sectional view of the fixing apparatus.

FIG. 6 is a perspective view of an outer appearance of the fixing apparatus 100 in this embodiment. FIG. 7 is a cross-sectional left side vie of a principal portion of the image forming apparatus 100 and shows an urged state of a lower-side belt assembly B.

Here, with respect to the fixing apparatus 100 or members constituting the fixing apparatus 100, a longitudinal direction (widthwise direction) or a sheet width direction is a direction substantially in parallel to a direction perpendicular to a conveyance direction D of the sheet S in a sheet conveying path plane. A short direction is a direction substantially in parallel to the sheet conveyance direction D.

Further, with respect to the fixing apparatus 100, a front surface is a surface in a sheet entrance side, and a rear surface is a surface in a sheet exit side. Left surface (side) and right surface (side) are those when the fixing apparatus 100 is viewed from the front surface. In this embodiment, the right side is a front side, and the left side is a rear side. Upper side and lower side are those with respect to the direction of gravitation. Upstream side (portion) and downstream side (portion) are those with respect to the sheet conveyance direction D.

The fixing apparatus 100 as the image treating apparatus in this embodiment is an image heating apparatus of a twin belt nip type, an electromagnetic induction heating (IH) type and an oil-less fixing type.

The fixing apparatus 100 includes an upper-side belt assembly A as a heating unit and the lower-side belt assembly B as a pressing unit. Further, the fixing apparatus 100 includes an IH heater (magnetic flux generating means) 170 as a heating means for heating a fixing belt 105 of the upper-side belt assembly A. Further, the fixing apparatus 100 includes a guiding mechanism 600 for guiding the sheet S, conveyed from the image forming portion (secondary transfer roller 14) side, into a fixing nip N thereof. These members will be sequentially described.

(2-1) Upper-Side Belt Assembly A and IH Heater 170

The upper-side belt assembly A is provided between left and right upper-side plates 150 of a fixing frame (fixing apparatus casing) 101. This assembly A includes a parting layer at its surface and includes a flexible endless fixing belt (heating endless belt) 105 as a rotatable member (rotatable heating member: fixing member). Further, the assembly A includes, as a plurality of belt stretching members for stretching the fixing belt 105, a driving roller (fixing roller) 131, a tension roller 132 and a pad stay 137.

The driving roller 131 is provided between the left and right upper-side plates 140 in the sheet exit side, and left and right shaft portions (not shown) are rotatably supported between the left and right upper-side plates 140 via bearings (not shown).

Each of the outside of the left and right upper-side plates 140, a tension roller supporting arm (not shown) is provided and extended from the driving roller 131 side to the sheet entrance side. The tension roller 312 is provided in the sheet entrance side between the left and right upper-side plates 140, and left and right shaft portions (not shown) thereof are rotatably supported by the above-described left and right supporting arms via bearings (not shown).

The pad stay 137 is a member formed of, e.g., stainless steel (SUS material). This stay 137 is fixed and supported between the left and right upper-side plates 140 at its left and right end portions so that the stay 131 is located inside the fixing belt 105 and closely to the driving roller 131 between the driving roller 131 and the tension roller 132 with a pad receiving surface downward. The fixing belt 105 extended around the driving roller 131, the tension roller 132 and the pad stay 137 is under application of a predetermined tension by movement of the tension roller 132 in a belt tension direction by an urging force of a tension spring (not shown).

In this embodiment, the tension of 200N is applied. A lower-side belt portion of the fixing belt 105 is contacted at its inner surface to the downward pad receiving surface of the pad stay 137.

As the fixing belt 105, any belt may be appropriately selected so long as the belt can be heated by the IH heater 170 and has heat resistance. For example, a belt prepared by coating a 300 μm-thick silicone rubber on a magnetic metal layer, such as a nickel layer or a stainless steel layer, of 75 μm in thickness, 380 mm in width and 200 mm in circumference and then by coating a PFA tube as a surface layer (parting layer) on the silicone rubber is used as the fixing belt 105.

The driving roller 131 is, e.g., a roller formed by integrally molding a heat-resistant silicone rubber elastic layer on a surface layer of a solid core metal formed of stainless steel in outer diameter of 18 mm. The driving roller 131 is provided in the sheet exit side in a nip region of the fixing nip N formed between the fixing belt 105 and a pressing belt 120 as a second rotatable member described later, and its elastic layer is elastically distorted in a predetermined amount by press-contact of the pressing roller 121 described later.

The tension roller 132 is, e.g., a hollow roller formed of stainless steel so as to have an outer diameter of 20 mm and an inner diameter of about 18 mm. The tension roller 132 stretches the fixing belt 105 to apply tension to the fixing belt 105.

To a roller shaft of the driving roller 131, a drive input gear (not shown) is coaxially provided and fixed in a left end side. To this gear, input of a driving force from a driving motor 301 (FIG. 6) is made via a drive transmission means (not shown), so that the driving roller 131 is rotationally driven in the clockwise direction indicated an arrow of FIG. 7 at a predetermined speed.

By the rotation of the driving roller 131, the fixing belt 105 is circulated and conveyed in the clockwise direction indicated by the arrow at a speed corresponding to the speed of the driving roller 131. The tension roller 132 is rotated by the circulation conveyance of the fixing belt 105. The inner surface of the lower-side belt portion of the fixing belt 105 slides and moves on the downward pad surface of the pad stay 137. In order to stably convey the sheet S to the fixing nip N described later, the driving force is transmitted with reliability between the frame 105 and the driving roller 131.

The IH heater 170 as the heating means for heating the fixing belt 105 is an induction heating coil unit constituted by an exciting coil, a magnetic core and a holder for holding these member, and the like. The IH heater 170 is disposed above the upper-side belt assembly A, and is fixed and disposed between the left and right upper-side plates 140 so that it extends from a portion of the upper surface of the fixing belt 105 to a portion of the tension roller 132 and opposes the fixing belt 105 in a non-contact manner with a predetermined gap therebetween.

The exciting coil of the IH heater 170 generates AC magnetic flux by being supplied with an AC current, and the AC magnetic flux is guided by the magnetic core to generate eddy current in the magnetic metal layer of the fixing belt 105 as an induction heat generating member. The eddy current generates Joule heat by specific resistance of the induction heat generating member. The CPU 10 controls the AC current to be supplied to the exciting coil so that a surface temperature of the fixing belt 105 is temperature-controlled at about 140° C. to about 200° C. (target temperature) on the basis of detection temperature information from a thermistor for detecting the surface temperature of the fixing belt 105.

(2-2) Lower-Side Belt Assembly A

The lower-side belt assembly B is provided under the upper-side belt assembly A. This assembly B is assembled with a lower frame (urging frame) 306 rotatably supported in the vertical (up-down) direction about a hinge shaft 304 fixedly provided between left and right lower-side plates 303 in the sheet exit side in the fixing apparatus 100.

This assembly B includes a flexible endless pressing belt (endless belt) 120 as an opposing member (rotatable pressing member: pressing member) for forming the nip N with the fixing belt 105. Further, the assembly B includes, as a plurality of belt stretching members for stretching the pressing belt 120, a pressing roller 121, a tension roller 122 and a pressing pad 125.

The pressing roller 121 is provided so that left and right shaft portions (not shown) thereof are rotatably supported between the left and right side plates of the lower frame 306 via bearings (not shown).

The tension roller 122 is provided so that left and right shaft portions (not shown) thereof are rotatably supported by the left and right side plates via bearings (not shown). Each of the bearings is supported slidably and movably in the belt tension direction relative to the lower frame 306 and is urged by a tension spring (not shown) so as to move in a direction in which the bearing is moved away from the pressing roller 121.

The pressing pad 125 is a member formed with, e.g., a silicone rubber, and left and right end portions thereof are fixed and supported between the left and right side plates of the lower frame 306.

The pressing roller 121 is located in the sheet exit side between the left and right side plates of the lower frame 306. The tension roller 122 is located in the sheet entrance side between the left and right side plates of the lower frame 306. The pressing pad 125 is non-rotationally supported and disposed so that the pad 125 is located inside the pressing belt 120 and closely to the pressing roller 121 between the pressing roller 121 and the tension roller 122 with a pad surface upward.

The pressing belt 120 extended around the pressing roller 121, the tension roller 122 and the pressing pad 125 is under application of a predetermined tension by movement of the tension roller 122 in the belt tension direction by an urging force of a tension spring (not shown). In this embodiment, the tension of 200N is applied. An upper-side belt portion of the fixing belt 105 is contacted at its inner surface to the upward pad surface of the pressing pad 125.

As the pressing belt 120, any belt may be appropriately selected so long as the belt has heat resistance. For example, a belt prepared by coating a 300 μm-thick silicone rubber on a nickel layer of 50 μm in thickness, 380 mm in width and 200 mm in circumference and then by coating a PFA tube as a surface layer (parting layer) on the silicone rubber is used as the pressing belt 120. The pressing roller 121 is, e.g., a slid roller formed of stainless steel in outer diameter of 20 mm. The tension roller 122 is, e.g., a hollow roller formed of stainless steel so as to have an outer diameter of 20 mm and an inner diameter of about 18 mm.

In the lower-side belt assembly B, the pressing 121 and the pressing pad 125 are press-contacted, by a pressing mechanism (not shown), to the pressing belt 120 toward the driving roller 131 and the pad stay 137 of the upper-side belt assembly A via the fixing belt 105.

As a result, between the fixing belt 105 of the upper-side belt assembly A and the pressing belt 120 of the lower-side belt assembly B, the fixing nip N having a predetermined width with respect to the conveyance direction of the sheet S.

Here, by the press-contact of the pressing roller 121 to the pressing belt 120 toward the driving roller 131, curvature deformation of about several hundreds of microns is generated on the driving roller 131 in a side opposite from the side where the driving roller 131 opposes the pressing roller 121. This curvature deformation of the driving roller (fixing roller) 131 constitutes a factor of depressure at a longitudinal central portion of the fixing nip N. In order to eliminate this depressure, the driving roller 131 or both of the driving roller 131 and the pressing roller 121 are formed in a crown shape, so that a nip shape provided by the driving roller 131 and the pressing roller 121 is made substantially straight. In this embodiment, the driving roller 131 is formed in a normal crown shape of 300 μm.

(2-3) Fixing Operation and Temperature Control

A fixing operation of the fixing apparatus 100 will be described with reference to a control flow chart of (a) of FIG. 8 and a block diagram of a control system of (b) of FIG. 8. During a stand-by state of the fixing apparatus 100, the lower frame 306 is lowered about the hinge shaft 304. As a result, the lower-side belt assembly B is held at a spaced position where the lower-side belt assembly B is moved downward from the upper-side belt assembly A in a non-contact manner. The drive of the driving motor 301 is stopped. Electric energy supply to the IH heater 170 is also stopped.

The CPU 10 starts predetermined image forming sequence control on the basis of input of a print job start signal. With respect to the fixing apparatus 100, at a predetermined control timing, a pressing motor 302 (FIG. 6) is driven via a motor driver (not shown). As a result, the pressing mechanism performs a pressing operation to raise the lower frame 306 about the hinge shaft 304. As a result, the lower-side belt assembly B is moved to a pressing position of FIG. 7 where the lower-side belt assembly B is press-contacted to the upper-side belt assembly A at predetermined pressure, so that the fixing nip N having the predetermined width is formed between the fixing belt 105 and the pressing belt 120 <S7-001>.

Next, the CPU 100 drives the driving motor 301 via a motor driver 301D to input the driving force into a drive input gear. As a result, the driving roller 131 of the upper-side belt assembly A is driven as described above to start rotation of the fixing belt 105.

Further, a rotational force of the drive input gear is transmitted to also the pressing belt 120 of the lower-side belt assembly B via a driving gear train (not shown), so that the pressing roller 121 is rotationally driven. With the rotation of the pressing roller 121 and by a frictional force with the rotating fixing belt 105, rotation of the pressing belt 120 is started in the counterclockwise direction indicated by an arrow <S7-002>. The movement directions of the fixing belt 105 and the pressing belt 120 are the same at the fixing nip N and moving speeds thereof are also substantially the same.

Next, the CPU 10 supplies electric power to the IH heater 170 via a heater controller 170C and a heater driver 170D ((b) of FIG. 9) to heat the rotating fixing belt 105 through electromagnetic induction heating, thus raising the fixing belt temperature to a predetermined target temperature to effect temperature contact. That is, the CPU 10 starts the temperature control such that the temperature of the fixing belt 105 is raised to the target temperature ranging from 140° C. to 200° C. (150° C. in this embodiment) depending on a basis weight or type of the sheet S to be passed through the fixing apparatus 100 and then is maintained at the target temperature <S7-003>.

Then, in a state in which the formation of the fixing nip N, the rotation of the fixing belt 105 and the pressing belt 120, and the temperature raising and temperature control of the fixing belt 105 are effected, the sheet S on which surface the unfixed toner image t (FIG. 7) is formed is guided from the image forming portion side into the fixing apparatus 100. The sheet S is guided by the guiding mechanism 600 provided at a sheet entrance portion of the fixing apparatus 100 to enter the fixing nip N which is the press-contact portion between the fixing belt 105 and the pressing belt 120. The guiding mechanism 600 is provided with a flag sensor 624 including a photo-interrupter, so that the flag sensor 624 detects passing timing of the sheet S.

The sheet S opposes the fixing belt 105 at its image-carrying surface and opposes the pressing belt 120 at its surface opposite from the image-carrying surface, and in this state, the sheet S is nipped and conveyed at the fixing nip N. Then, the unfixed toner image t is fixed as fixed image on the sheet surface by heat of the fixing belt 105 and the nip pressure. The sheet S having passed through the fixing nip N is separated from the surface of the fixing belt 105 and comes out of the fixing apparatus 100 from the sheet exit side, and then is conveyed and discharged onto a discharge tray 21 by a discharging roller pair 20 (FIG. 5).

Then, when the conveyance of the sheet S in the print job of a predetermined single sheet or a plurality of successive sheets is ended, the CPU 10 ends the heating and temperature control of the fixing belt 105 and turns off the power supply to the IH heater 170 <S7-004>. Further, the driving motor 301 is turned off to stop the rotation of the fixing belt 101 and the pressing belt 120<S7-005>.

Further, the CPU 10 drives the pressing motor 302 via the motor driver to cause the pressing mechanism to perform a pressure-releasing operation, so that the lower frame 306 is lowered and moved about the hinge shaft 304. As a result, the lower-side belt assembly B is moved to the spaced position from the upper-side belt assembly A, thus eliminating the fixing nip N <S7-006>. In this state, the CPU 10 waits for input of a subsequent print job start signal.

With reference to a control flow chart of (a) of FIG. 9 and a black diagram of a control system of (b) of FIG. 9, temperature control of the fixing belt 105 will be described. In the upper-side belt assembly A, a thermistor as a temperature detecting member for detecting the surface temperature of the fixing belt 105 is provided. The CPU 10 supplies the electric power to the IH heater 170 via the heater controller 170C and the heater driver 170D at predetermined control timing on the basis of the input of the print job start signal <S8-001>. The fixing belt 105 is created in temperature through the electromagnetic induction heating by the IH heater 170.

The temperature of the fixing belt 105 is detected by the thermistor, and detection temperature information (electrical information on the temperature) is inputted into the CPU 10. The CPU 10 stops the supply of the electric power to the IH heater 170 when the detection temperature by the thermistor is not less than a predetermined value (target temperature) (<S8-002> and <S8-003>). Thereafter, the CPU 10 resumes, when the detection temperature by the thermistor is lower than the predetermined value <S8-004>, the supply of the electric power to the IH heater 170<S8-001>.

By repetition of the above-described steps <S8-001> to <S8-004>, the fixing belt 105 is temperature-controlled and kept at the predetermined target temperature. Then, the above fixing belt temperature control is executed until the print job of the predetermined single sheet or the plurality of successive sheets is ended (S8-005>, (2-4) Guiding mechanism 600

Figure 1:
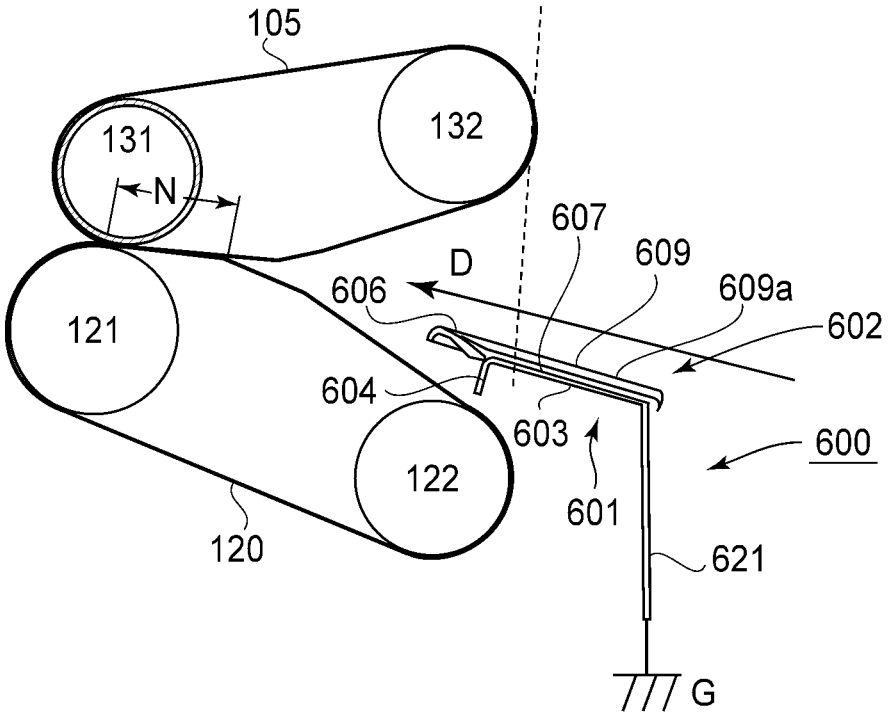
FIG. 1 is a schematic illustration of a fixing apparatus in an Embodiment.
Figure 2:
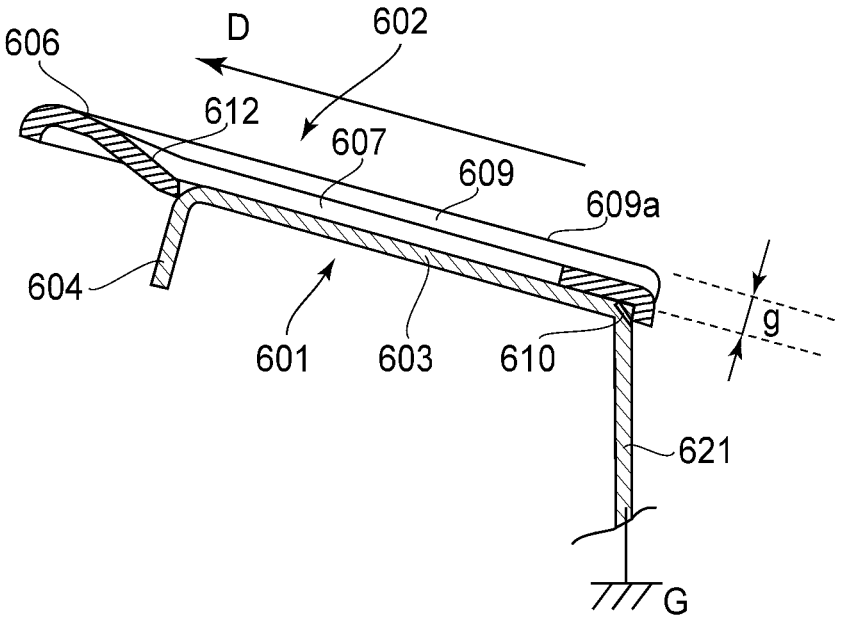
FIG. 2 is an enlarged perspective view of a guiding mechanism portion.
Figure 3:
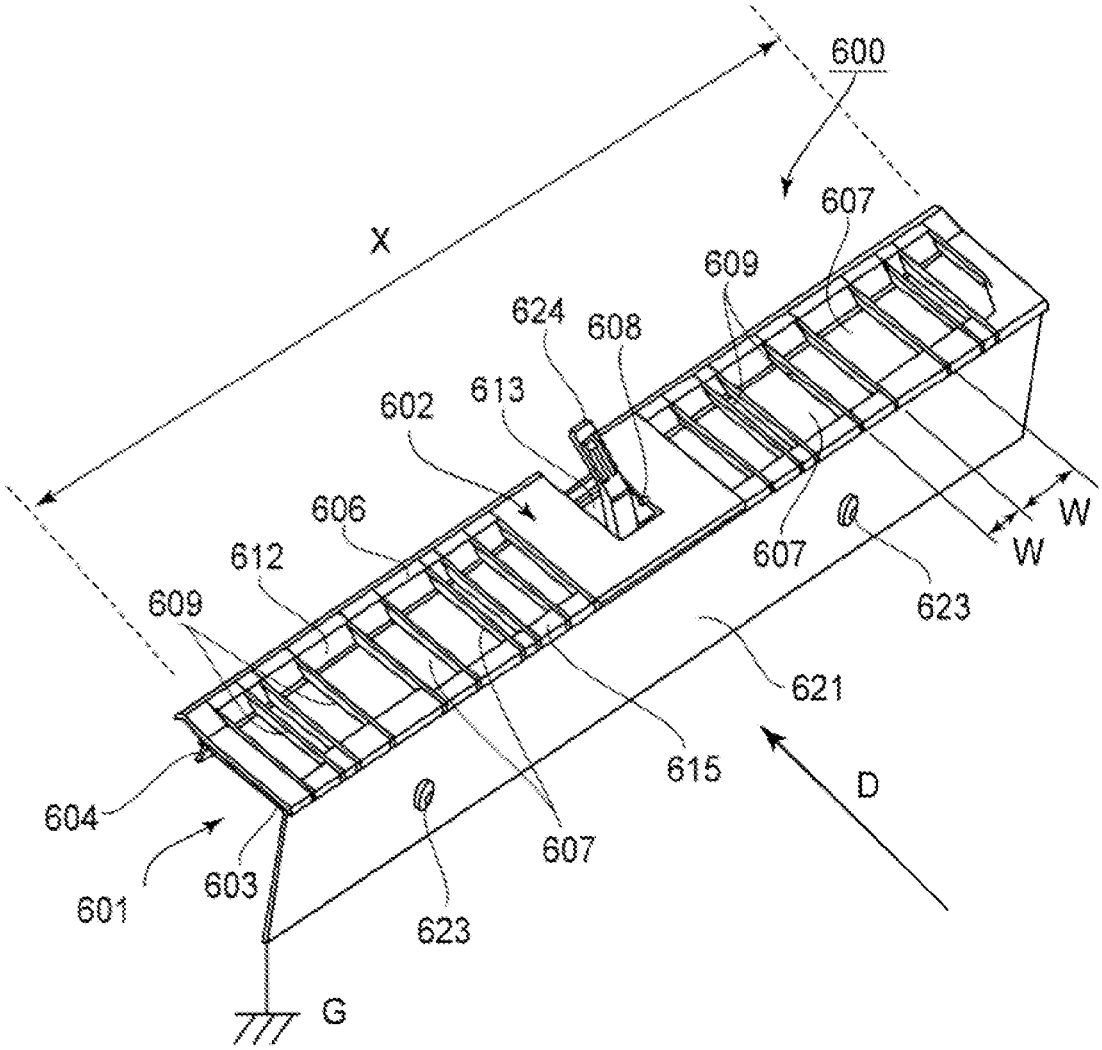
FIG. 3 is a perspective view of a guiding mechanism.
Figure 4:
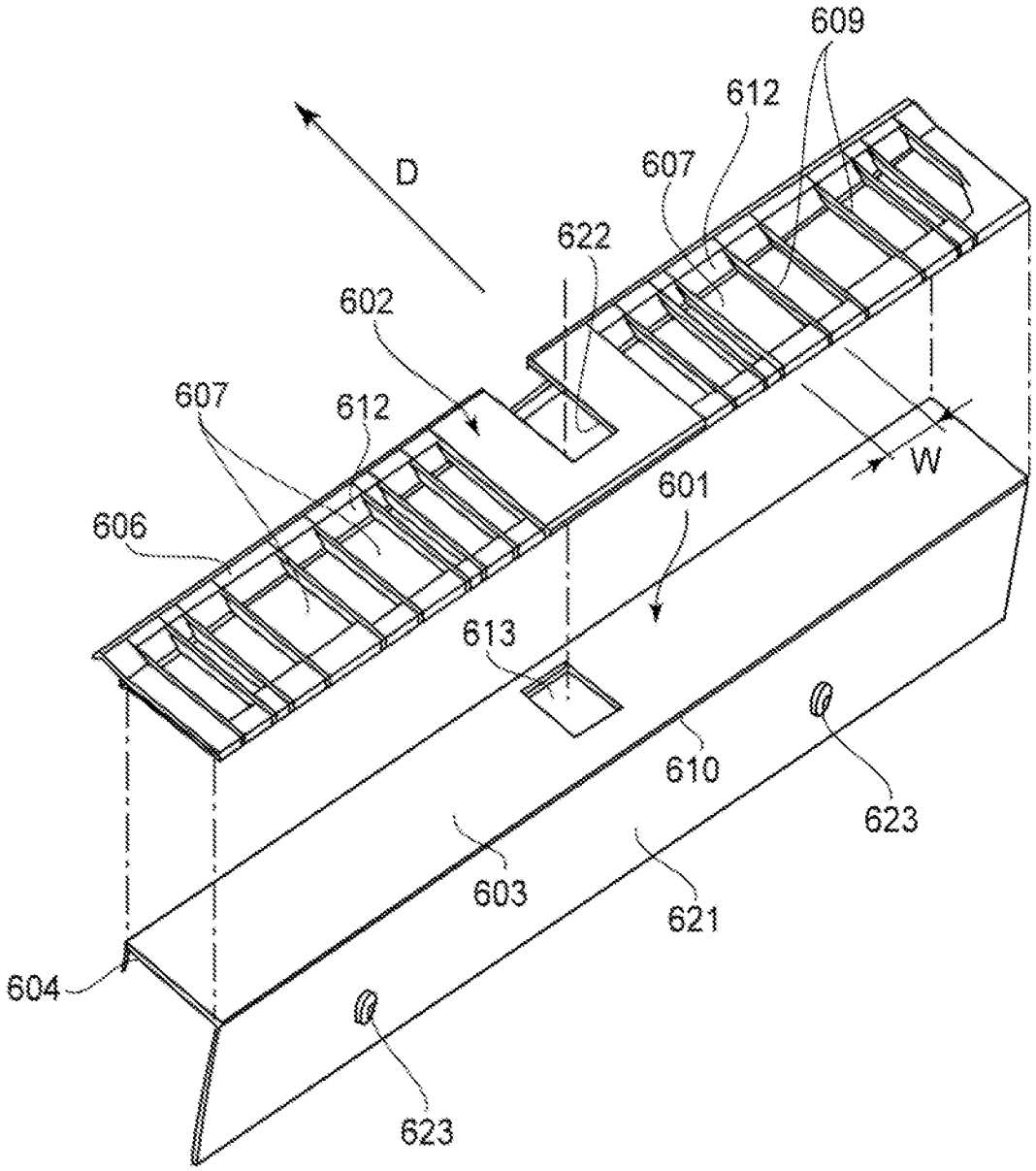
FIG. 4 is an exploded perspective view of the guiding mechanism.

FIG. 1 is a schematic enlarged view of a principal portion of FIG. 7, and FIG. 2 is an enlarged view of the guiding mechanism (guiding member) 600 shown in FIG. 1. FIG. 3 is a perspective view of an outer appearance of the guiding mechanism 600, and FIG. 4 is an exploded perspective view of the guiding mechanism 600.

The guiding mechanism 600 has the function of guiding the sheet S, introduced from the image forming portion side into the fixing apparatus 100, to the fixing nip N in a sheet conveyance region X (FIG. 3) of a maximum width size usable in the fixing apparatus 100. The guiding mechanism 600 is provided and positionally fixed in non-contact with both of the fixing belt 105 and the pressing belt 120 in an upstream side of the fixing nip N, formed by the press contact between the fixing belt 105 and the pressing belt 120, with respect to the sheet conveyance direction D.

The guiding mechanism 600 includes an electroconductive attraction member 601 which is extended over the sheet conveyance region X (FIG. 3) and which is electrically grounded (G). Further, the guiding mechanism 600 includes an insulating sheet guiding member 602, extended over the sheet conveyance region X (FIG. 3), for guiding the sheet S in contact with the back surface opposite from the image-carrying surface of the sheet S. The sheet guiding member 602 is formed by integral molding using an insulating resin material having a volume resistivity of $1\times10^{6}$-$1\times10^{16}$ Ωcm.

First, the attraction member 601 will be described. In this embodiment, the attraction member 601 is an electroconductive metal plate, elongated along a longitudinal direction (left-right direction) of the fixing nip N, which is formed by folding and molding of a 1.0 mm-thick electro-galvanizing steel plate ("Zincoat 21"). The attraction member 601 includes a sheet attraction surface portion 603 substantially in parallel to a sheet guiding direction by the guiding mechanism 600.

A downstream portion of the attraction surface portion 603 with respect to the sheet guiding direction by the guiding mechanism 600 overlaps with a projected image of the fixing belt 105 on the sheet conveyance path surface.

The attraction member 601 includes a first bent portion 604 bent downward (toward the pressing belt 120) from the attraction surface portion 603 along the longitudinal direction of the attraction surface portion 603 in the downstream side of the attraction surface portion 603 with respect to the sheet conveyance direction D (i.e., at a fixing nip-side end portion of the attraction member 601 with respect to the sheet conveyance direction D). Further, the attraction member 601 includes a second bent portion 621 bent downward from the attraction surface portion 603 in the upstream side of the attraction surface portion 603 with respect to the sheet conveyance direction D (i.e., at an end portion opposite from the first bent portion 604 of the attraction member 601). Further, the attraction member 601 includes an opening 622 formed at a substantially central portion of the attraction surface portion 603 with respect to the longitudinal direction.

The attraction member 601 is fastened to a fixing apparatus frame 101 (FIG. 7), which is a fixing apparatus casing, at the second bent portion 621 using screws 623. The fixing apparatus frame 101 is grounded (G) along a grounding path (not shown) and therefore also the attraction member 601 which is physically contacted to the fixing apparatus frame 101 by screw fastening is grounded (G).

The first bent portion 604 is extended in the fixing nip-side direction (downstream direction) of the sheet conveyance direction D with respect to the tension roller 132 for stretching the fixing belt 105. That is, the downstream portion of the attraction surface portion 603 with respect to the sheet guiding direction by the guiding mechanism 600 overlaps with the projected image of the fixing belt 105 on the sheet conveyance path surface.

In this embodiment, the secondary transfer portion (transfer means 14), where the unfixed toner image t is electrostatically transferred onto the sheet S, and the fixing apparatus (fixing means) 100 are disposed substantially in the horizontal direction, and therefore the attraction surface portion 603 and the first bent portion 604 are extended to below the tension roller 132. On the other hand, in the case where the transfer portion and the fixing portion are disposed in the vertical direction, the first bent portion is extended in a lateral direction.

Next, the sheet guiding member (insulating resin member) 602 will be described. The sheet guiding member 602 is a plate-like member elongated along the longitudinal direction (left-right direction) of the fixing nip N so as to be disposed to cover the attraction surface portion 603 of the attraction member 601, and is a molded member of an electrically insulating (non-electroconductive) material (volume resistivity: $1\times10^{6}$-$1\times10^{16}$ Ωcm). In this embodiment, an alloy material of polybutylene terephthalate (PBT) with an ABS resin (PBT+ABS) (volume resistivity: $10^{10}$ Ωcm) is integrally molded.

A sheet sliding portion (slidable with the back surface of the sheet S: the surface of the guiding rib 609) 609*a* of the sheet guiding member 602 is formed substantially in parallel to the surface of the attraction surface portion 603 of the attraction member 601 and is also formed substantially along the sheet conveyance direction D, and guides movement of the sheet S in the sheet conveyance direction detect in contact with the back surface of the sheet S.

An end portion (downstream portion which is flat with respect to the direction perpendicular to the sheet conveyance direction) 606 which is extended in the downstream direction more than the first bent portion 604 of the attraction member 601 and which has a flat shape (substantially free from a stepped portion) is formed at a downstreammost end portion of the sheet guiding member 602 with respect to the sheet conveyance direction D. This end portion 606 is provided over a whole area of the sheet conveyance region (FIG. 3) along the longitudinal direction of the sheet guiding member 602. Further, at the sheet sliding portion 609*a* of the sheet guiding member 602, guide openings 607 as a plurality of openings and an opening 608 which is located at a substantially longitudinal central portion are provided. A longitudinal width (dimension with respect to the sheet guiding direction) of each of the guide openings 607 ranges from, e.g., 4.7 mm to 21 mm.

The guide openings 607 expose the attraction surface portion 603 therethrough in a state the attraction surface portion 603 of the attraction member 601 is covered with the sheet guiding member 602. Further, at an end portion defining adjacent guide openings 607, the guiding rib 609 is provided along the longitudinal direction (sheet conveyance direction D). That is, the rib-shaped portion is formed between adjacent guide openings 607. The (upper) surface 609*a* of each rib 609 is the sheet sliding portion of the sheet guiding member 602.

The opening 608 is located correspondingly to the opening 622 of the attraction surface portion 603 in a state in which the attraction surface portion 603 of the attraction member 601 is covered with the sheet guiding member 602. Further, inside the guiding mechanism 600, the flag sensor 624 which is provided on the fixing apparatus frame 101 and which includes the photo-interrupter is exposed from the inside to outside of the guiding mechanism 600 through the openings 622 and 608.

The opening 608 is formed to cover an edge portion of the opening 613 of the attraction surface portion 603 with respect to the sheet S and also so as not to hinder the operation of the flag sensor 624. The flag sensor 624 is tilted by the sheet S moving on the sheet guiding member 602, thus detecting passing timing of the sheet S in cooperation with the photo-interrupter.

The sheet S on which the unfixed toner image t is formed is electrically charged by applying a transfer bias to the transfer means 14. When the charged sheet S passes on the guiding mechanism 600, at the attraction surface portion 603 of the attraction member 601 which is grounded (G), electric charges of an opposite polarity to the charge polarity of the sheet S is excited. As a result, an attraction force is generated by electrostatic induction between the sheet S and the attraction surface portion 603, so that the sheet S is attracted to the attraction surface portion 603. The attracted sheet S contacts the sheet sliding portion 609*a* of the sheet guiding member 602 at its back surface and is conveyed along the sheet guiding member 602.

An upstream edge portion 610 of the attraction surface portion 603 with respect to the sheet conveyance direction is covered with the sheet guiding member 602 with respect to the sheet S. A gap (distance) q between the surface 609*a* of the rib guide 609 of the sheet guiding member 602 and the attraction surface portion 603 of the attraction member 601 disposed substantially in parallel to the sheet guiding member 602 may desirably be 3.0 mm or less in order to ensure the electrostatic induction with the sheet with reliability.

Further, with respect to the sheet material having a basis weight of 400 gsm or less, in order to suppress the contact between the sheet S and the attraction surface portion 603 caused due to the attract force generated by the self-weight and the electrostatic induction, the gap g may desirably be set as follows. It is desirable that the gap 8 is 1.0 mm or more and a spacing g with the surface (sheet contact surface) 609*a* of the guide rib 609 is 3.0 mm to 25 mm. That is, a minimum distance between the surface of the attraction surface portion 603 and the contact surface 609*a* of the guiding member 602 to the sheet S may desirably be 1.0-3.0 mm.

In this embodiment, the gap g is 1.6 mm. Further, the guide ribs 609 may appropriately disposed at an interval W of 3.0 mm to 25 mm so that they are located at a position of 2.0 mm from a longitudinal end of the sheet having a typical sheet size used in the image forming apparatus in this embodiment. That is, the plurality of openings 607 described above are formed with the width of 3.0-25 mm with respect to a direction perpendicular to the sheet guide direction.

As a result, the sheet S can be conveyed in non-contact with the attraction member 601 while being attracted to the sheet guiding member 602 side. That is, the non-electroconductive sheet guiding member 602 suppresses the contact of the sheet S with the attraction member 601 which is an electroconductive member. For that reason, it becomes possible to suppress abnormal image generated at the secondary transfer portion by passing of a current, generated by the bias voltage applied at the secondary transfer portion, through the attraction member 601 via the sheet S.

The openings 607 have a longitudinal width (dimension with respect to the sheet guide direction) of, e.g., 4.7 mm to 21 mm, and the ribs 609 are provided between the openings 607.

In the downstream side of the attraction surface portion 603 of the attraction member 601 with respect to the sheet conveyance direction D, the first bent portion 604 bent downward (toward the pressing belt 120) from the attraction surface portion 603 along the longitudinal direction of the attraction surface portion 603 is provided. For that reason, the distance g between the surface 609*a* of the guide rib 609 and the attraction surface portion 603 is asymptotically increased. That is, the downstream end portion of the attraction surface portion 603 with respect to the sheet guide direction is asymptotically spaced from the sheet contact portion 609*a* of the sheet guiding member 602. As a result, the attraction force to the sheet S can be asymptotically lowered, so that it becomes possible to convey the sheet S more stably to the neighborhood of the fixing nip.

At each opening 607 of the sheet guiding member 602, an inclined surface (inclined portion) 612 is formed at an edge portion with respect to the sheet conveyance direction. This inclined surface 612 asymptotically connects the guide opening 607 and the end portion 606 of the guiding member 601 with respect to the direction close to the sheet S, thus suppressing catch of the leading end of the sheet S at the opening 607.

The end portion 606 of the attraction member 601 is formed in a flat shape (substantially free from a stepped portion) having a partly round shape that is in the shape of a backwards "r" in FIG. 2 at its edge in the fixing nip side. For that reason, the sheet S attracted by the attraction surface portion 603 of the attraction member 601 can enter the fixing nip in a state in which the above-described wavy state is eliminated.

Further, the following effect is achieved by extending the attraction surface portion 603 of the attraction member 601 to below the fixing belt 105. The fixing belt 105 as the fixing member is coated with a PFA tube positively charged strongly at its surface in many cases, and the sheet S tends to be positively charged. Therefore, the sheet S is liable to be electrostatically attracted to the sheet S. Therefore, by extending the attraction surface portion 602 of the attraction member to below the fixing belt 105, the attraction force from the fixing belt 105 is canceled, so that a sheet conveyance property is stabilized.

In a conventional constitution in which ribs are formed on the guide surface and an electroconductive member is provided between the ribs, the sheet S was bent by its own weight to be deformed in a wavy shape at an end of the ribs in some cases. When the sheet S is deformed in the wavy shape, the sheet S buckles in the fixing nip to cause buckling deformation of the sheet S in a crease shape.

Further, in the conventional constitution, the edge portion of the electroconductive member is exposed to the sheet S, so that the electric charges concentrated at the edge portion (upstreammost end portion of the attraction surface portion 603 with respect to the sheet conveyance direction) in the metal plate entrance side where the current flows readily to generate corona discharge between itself and the sheet S in some cases. When the corona discharge is generated, the electric charges for holding the unfixed toner image disappear and therefore the unfixed toner image moves on the sheet S, so that the abnormal image such as tailing was caused to occur.

Therefore, in this embodiment, in the sheet conveyance region X, a constitution in which the edge portion in the metal plate entrance side is covered with the shielding portion 615 (FIG. 3) of the sheet guiding member formed of the insulating resin material is employed. As shown in FIG. 3, the shielding portion 615 is extended over the whole sheet conveyance region so as to shield the edge portion in the metal plate entrance side.

Therefore, according to the constitution in this embodiment, also in the image forming apparatus having the constitution in which the belt-like fixing member is projected onto the sheet conveyance path, the following effects can be obtained.

That is, by the electrostatic induction generated between the attraction member 601 and the sheet S, it becomes possible to suitably convey the sheet S in proximity to or in contact with the sheet guiding member 602. Further, a degree of abnormal image/conveyance due to electrical and physical stresses caused by such conveyance is reduced, and thus the sheet S can be conveyed.

Further, with a larger urging force by which the sheet S is urged against the guiding member 602, a more suitable effect can be obtained in this embodiment. Particularly, this embodiment is suitable in the case where the constitution in this embodiment is applied to the image forming apparatus in which the transfer portion where the unfixed toner image is transferred to the sheet S and a fixing portion where the unfixed toner image is fixed on the sheet S under application of heat and pressure are disposed substantially is a horizontal direction. That is, by the effect of the end portion 606 of the guiding member 602, a degree of disturbance of attitude of the sheet S by the self-weight of the sheet S when the sheet S enters the fixing nip can be reduced suitably.

The embodiment according to the present invention is described above in detail, but various constitutions can be replaced with other known constitutions within the scope of the present invention. For example, in the above embodiment, description was made by using the fixing apparatus in which the fixing nip is formed by pressing the belt by the rollers for stretching the belt. The present invention is not limited thereto but even when the pressing member is a roller-shaped member (rotatable roller member), a similar effect can be obtained.

Further, the fixing member 105 may also be a rotatable roller member, and the pressing member 120 may also be a rotatable endless belt member. Further, both of the fixing member 105 and the pressing member 120 may also be a rotatable roller member. Further, the pressing member as an opposing member may also be a non-rotatable member, such as a pad or a plate-like member, having an low frictional efficiency at the surface as the contact surface with the fixing member 105 or the sheet S.

The heating mechanism in the case where the rotatable member 105 and the pressing member 120 are heated is not limited to the electromagnetic induction heating mechanism, but another heating mechanism such as a halogen heater may also be used. The fixing apparatus may also have the constitution of an internal heating type in which the heating means such as the halogen heater is provided inside the during roller (fixing roller) 131 or the pressing roller 121.

The fixing treatment in the fixing nip N may be heat and pressure treatment or pressure treatment.

The image forming portion of the image forming apparatus is not limited to that of the electrophotographic type but may also be those of an electrostatic recording type or a magnetic recording type. Further, the transfer type is not limited, but it is also possible to employ a constitution in which the unfixed image is directly formed on the sheet.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 097655/2012 filed Apr. 23, 2012, which is hereby incorporated by reference.

What is claimed is:

1. A fixing apparatus comprising:

a fixing device configured to fix a toner image on a sheet at a nip; and a guiding member configured to guide the sheet toward the nip, wherein said guiding member comprises:

an electroconductive metal plate which is electrically grounded; and an insulating resin member, provided to cover a part of said metal plate, slidable with the sheet, and wherein said resin member comprises:

a plurality of openings, provided at different positions with respect to a direction perpendicular to a sheet conveyance direction, for permitting exposure of said metal plate along the sheet conveyance direction; and a flat portion, substantially free from a stepped portion, which is provided at a downstreammost portion with respect to the sheet conveyance direction and which is extended at least along the entire region in which said flat portion is slidable with the sheet in the direction perpendicular to the sheet conveyance direction.

2. A fixing apparatus according to claim 1, wherein said resin member includes an inclined portion provided so as to approach said metal plate from said flat portion in a direction opposite to the sheet conveyance direction.

3. A fixing apparatus according to claim 1, wherein said resin member includes a shielding portion provided, at a upstreammost portion with respect to the sheet conveyance direction, so as to cover an edge portion of said metal plate.

4. A fixing apparatus according to claim 1, wherein said plurality of openings have a width of 3.0-25 mm with respect to the direction perpendicular to the sheet conveyance direction.

5. A fixing apparatus according to claim 1, wherein in the sheet conveyance region, a minimum of a gap between a sheet sliding surface of said resin member and said metal plate is 1.0-3.0 mm.

6. A fixing apparatus according to claim 1, wherein said resin member has a volume resistivity of $1\times10^{6}$-$1\times10^{16}$ Ωcm.

7. A fixing apparatus according to claim 1, wherein said fixing device includes a fixing belt and a pressing belt which form the nip, and wherein a part of said guiding member is located in a space between said fixing belt and said pressing belt.

8. A fixing apparatus comprising:

a fixing device configured to fix a toner image on a sheet at a nip; and a guiding member configured to guide the sheet toward the nip, wherein said guiding member comprises:

an electroconductive metal plate which is electrically grounded; and an insulating resin member, provided to cover a part of said metal plate, slidable with the sheet, and wherein said resin member comprises:

a plurality of rib portions, provided at different positions with respect to a direction perpendicular to a sheet conveyance direction, formed along the sheet conveyance direction;

a plurality of openings, each provided between adjacent rib portions, for permitting exposure of said metal plate; and a flat portion, substantially free from a stepped portion, which is provided at a downstreammost portion with respect to the sheet conveyance direction so as to be connected with said plurality of rib portions and which is extended at least along the entire region in which said flat portion is slidable with the sheet in the direction perpendicular to the sheet conveyance direction.

9. A fixing apparatus according to claim 8, wherein said resin member includes an inclined portion provided so as to approach said metal plate from said flat portion in a direction opposite to the sheet conveyance direction.

10. A fixing apparatus according to claim 8, wherein said resin member includes a shielding portion provided, at an upstreammost portion with respect to the sheet conveyance direction, so as to cover an edge portion of said metal plate.

11. A fixing apparatus according to claim 8, wherein said plurality of openings have a width of 3.0-25 mm with respect to the direction perpendicular to the sheet conveyance direction.

12. A fixing apparatus according to claim 8, wherein in the sheet conveyance region, a minimum of a gap between a sheet sliding surface of said resin member and said metal plate is 1.0-3.0 mm.

13. A fixing apparatus according to claim 8, wherein said resin member has a volume resistivity of $1\times10^{6}$-$1\times10^{16}$ Ωcm.

14. A fixing apparatus according to claim 8, wherein said fixing device includes a fixing belt and a pressing belt which form the nip, and wherein a part of said guiding member is located in a space between said fixing belt and said pressing belt.

* * * * *